US009501893B2

(12) United States Patent
Laird

(10) Patent No.: US 9,501,893 B2
(45) **Date of Patent: *Nov. 22, 2016**

(54) CONTRACT THE GAME OF THE CENTURY

(71) Applicant: Noble Laird, Center Moriches, NY (US)

(72) Inventor: Noble Laird, Center Moriches, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/155,306

(22) Filed: May 16, 2016

(65) Prior Publication Data

US 2016/0314647 A1 Oct. 27, 2016

Related U.S. Application Data

(63) Continuation of application No. 13/998,377, filed on Oct. 28, 2013, now Pat. No. 9,342,959.

(51) Int. Cl.
*G07F 17/32* (2006.01)

(52) U.S. Cl.
CPC ..... *G07F 17/3216* (2013.01); *G07F 17/329* (2013.01)

(58) Field of Classification Search
CPC ..... G07F 17/3286; A63F 5/00; A63F 5/02
See application file for complete search history.

(56) References Cited

U.S. PATENT DOCUMENTS

| | | | | |
|---|---|---|---|---|
| 4,380,335 | A * | 4/1983 | Chaudhry | A63F 7/025 273/121 A |
| 6,899,328 | B2 * | 5/2005 | Halliburton | G07F 17/3297 273/138.1 |
| 2005/0288089 | A1 * | 12/2005 | Cammegh | A63F 5/00 463/17 |
| 2010/0291989 | A1 * | 11/2010 | Kido | G07F 17/326 463/17 |
| 2014/0187306 | A1 * | 7/2014 | Nordahl | G07F 17/3202 463/17 |

* cited by examiner

*Primary Examiner* — Corbett B Coburn
(74) *Attorney, Agent, or Firm* — Alfred M Walker; Harvey Lunenfeld

(57) ABSTRACT

A game assembly for a game associated with instructions and rules for use in playing the game includes a housing having a spinning wheel with slots and numbers used for making wagers, and a wager calculations device. The housing further has a miniature basketball net through which a player participant throws a miniature basketball onto said spinning wheel, and a plurality of miniature basketballs having varying point denominations thereon for wagering. A hand-held remote controller controlling time limits per unit of said game; and the hand-held remote controller controls audio visual displays displayed on the housing, which are related to the game. The wager calculations device maybe the hand held remote controller, or a separate a flat wager board having respective slots and numbers corresponding to those displayed on the spinning wheel.

8 Claims, 5 Drawing Sheets

CONTRACT THE GAME OF THE CENTURY

RELATED APPLICATIONS

This application is a continuation of application Ser. No. 13/998,377, filed Oct. 28, 2013. Applicant claims priority under 35 U.S.C. §120. The '377 application is incorporated by reference herein.

BACKGROUND

The game of "Roulette" is a standard and public domain casino game where contractors/operators may make wagers on a number, group of numbers such as a row, column, "corner," "split" or "street," or a number characteristic, such as "odd" or "even," or a "red number" or a black number." The mechanism of the number generation in the Roulette game is determined by spinning a ball in a grooved gutter over a rotating wheel, where the ball later drops into a numbered slot on the wheel to determine the number result. This is the basic form of the game.

OBJECTS OF THE INVENTION

In contrast to the conventional game of Roulette, the present invention known as "Contract, The game of the century", is obviously different in many respects. For example wagers are made on a flat wager board specially designed to look similar to the contract wheel. The ball resembling a basketball has a number 1, 5, 10, or 20 on its face and is used, along with the separate accessory wager board, to make wagers. The ball is tossed into a basket netting a score of 200 times the number on the face of the ball tossed on a made shot. No points are lost on a missed shot for the player/contestant shooter, or the person tossing the ball, however points can still be lost or gained depending on where the tossed ball ultimately lands on the contract wheel. To start the game, teams must secure contracts with the contractors/operators. This is accomplished by each of the four teams selecting contract chips from their supply of colored contract chips, 8 of any value each having either a 1, 5, 10, or 20 on the face of the contract chip to be used as wagers. The contract chips are placed on the unique contract wager board which is designed to look like the contract wheel, in an attempt to aid the contractors/operators to guess where the tossed ball will land, thus netting the winner or loser the number on the face of the ball times the winning number on the wager board. Additionally, other new types of bets can be designed for the game of "Contract" that are not a part of the existing bet structure as defined above. This is the area where this patent pertains, as it not only describes a new and proprietary bet structure for the game of Roulette, but includes the new design of the Roulette wheel; named the contract wheel, in combination with the miniature basketball net. This contract wheel is no ordinary Roulette wheel, as the contract wheel preferably has only 18 slots represented as follows 10, 20, and 50 point slots, preferably two of each on black and two of each on red, one each 100 point slots, one on black and one on red. For example the aforesaid numbers occupy spaces as such two 10 point slots on black, two 20 point slots on black, two 50 point slots on black, one 100 point slot on black, two 10 point slots on red, two 20 point slots on red, two 50 point slots on red, one 100 point slot on red, two lose 200 point slots which are yellow, and two slots for the bull's-eye worth 200 points, which are green, for a total of 18 slots. Each slot is fitted with a molded indenture designed to fit the contract ball, once it goes through the miniature basketball net, and lands on the contract wheel. The specially designed wager board looks similar to the wheel and contains spaces as such: two 10 point spaces on black, two 20 point spaces on black, two 50 point spaces on black, one 100 point space on black, two 10 point spaces on red, two 20 point spaces on red, two 50 point spaces on red, one 100 point space on red, two lose 200 point spaces which are yellow, and one space for the bull's-eye worth 200 points which is green and is used solely to wager that the ball will land on that spot, however should the player/contestants want to wager that the player/contestant shooter of the miniature basketball will make or miss the shot, the player/contestant would place his or her wager on one space for the bull's-eye worth 200 points in the middle of the board, which is divided in half, one side for a wager that the player/contestant shooter makes the basket and marked "bet here to make bulls eye basket", or the other side is a wager that he or she misses the aforesaid shot, and marked "bet here to miss bulls eye basket", for a total of 19 spaces.

This game also features shooting baskets with a time clock expiring and a buzzer sounding. More specifically; the game features tossing a miniature basketball with a contracted number on the face into a basket complete with rim, net and a time clock. The chief contractor/operator using the unique electronic contract remote controller, starts the contract wheel, making it spin around, as a time clock begins its countdown, allowing only 5 seconds to shoot the ball before a buzzer sounds, much like that at a basketball game. Player/contestants toss one of their preselected miniature contract basketballs at the miniature bulls-eye basket. Initially, the player/contestant may be filled with jubilation if he or she made the basket, but then feels only despair if he or she missed it. But because player/contestant shooters lose no points on a missed basket, the player/contestant is typically not too worried. But this session is not over, because the excitement and anticipation continues as the player/contestant shooter, his or her teammate and the other team competitors watch to see if the tossed contract ball settles on a black or red slot or on the numbered slot they wagered on the separate accessory contract wager board.

To land on black is always good for the player/contestant shooter but he or she loses the number on the face of the tossed ball times the number on the red slot he or she lands on. However the player/contestant shooter or any other player/contestant could deliberately place a bet on a red number and if the ball lands on red and is on the correctly number chosen, it wins the bettor the number on the face of the tossed ball times the number of the red slot landed on. Everyone is set to cheer or groan as the contract wheel slows to a stop to reveal the miniature basketball's final resting spot on the Roulette wheel below the miniature basketball basket, as this determines the payouts for the wagers made by the player/contestant shooter, his or her teammate and the other game participants, called "bettors". Such wagers were made by contestants (i.e. player/contestants) by placing wager chips with numbers on the face onto the accessory contract wager board in an attempt to anticipate the numbered slot the ball will eventually comes to rest on. A winning wager would net the bettor the number on the wager chip times the number the space wagered on occupies.

Another feature of the game is the above-noted contract remote controller. Nothing is more novel or exciting than the contract remote controller. Because the contract remote controller can be quickly programmed to have a personality, in that way, no two games need sound alike. In fact, the chief contractor/operator gets to determine the personality that consoles or congratulates the game participants, in any of four different languages, and choosing from one of a plurality of personalities, such as, for example, eight personalities, such as, for example, personality types including maniacal, syfy, gnome, sensual female, valley girl, chipmunk, infant child, and hysterical. The handheld remote controller is used solely by the chief contractor/operator. The aforesaid chief contractor/operator also uses the handheld contract remote controller to start the time clock, start the contract wheel, activate the flashing strobe lights and ringing bells. When an attempted toss is negative he or she uses one of his programmed buttons to make an electronic image of an expression of disappointment, or when an attempted toss is successful, he or she uses one to make an electronic image of an expression of jubilation. The handheld remote controller also features much more as described under the sub heading "How to operate the contract remote controller." The aforesaid handheld remote controller also serves as a calculator to assist in calculation of payouts. "Contract, the game of the century"; This is configured to live up to its name and is configured to grab the attention of the guest player/contestants, and have them transfixed all night.

BRIEF SUMMARY OF THE INVENTION

"Contract the game of the century"™ is a new and exciting game, combining several features that are appealing to the masses. The "Contract" game allows a player/contestant to bet that the game's player/contestants, including his own teammate, will make or miss a basket by throwing a miniature basketball therethrough, or bet on where his or tossed miniature basketball will land once it falls on the contract roulette wheel. The player/contestants, such as, for example, eight players, are supervised by two contractors/operators; the chief contractor/operator and his assistant. After teammates select the 8 miniature basketballs, and the 8 contract wager chips, these miniature basketballs and chips are then called "contracts", because of the numbers on the face and that they must be selected prior to the beginning of play and cannot be reneged on, but are binding; hence the name of the game. The miniature basketballs and chips which have either a 1, 5, 10 or 20 on the face are used to make wagers on the play. The numbers are multiplied by the number the ball lands on the contract Roulette wheel for the player/contestant shooter, but the chips get multiplied by the number on the chip times the number wagered on the wager board. The game ends after four quarters. A quarter is complete once one player/contestant for all four teams has tossed a ball at the bull's eye basket. The four teams start the game with equal amounts of chips in their respective chip sacks. The winning team is the team with the teammates with the most points in chips left in their combined chip sacks at the end of the fourth quarter, at which time all player/contestants on all teams would have each tossed two miniature basketballs.

Detailed Description of the Game

Contract-the game of the century is played as follows;

The game participants, up to ten, include players/contestants and two managerial contractors; the chief contractor/operator, who handles the contract remote controller, spins the contract wheel and handles the contracts and payouts for the game player/contestants when they act as the designated player/contestant shooter, and the assistant contractor/operator, who handles the contracts and payouts for the game player/contestants when they act as bettors. The player/contestants are divided into four teams, preferably consisting of two player/contestants per team. Each team is identified by color; red, black, blue or green. The game begins with the chief contractor/operator establishing contracts with the player/contestants. This is done by the player/contestants from all four teams choosing from their supply of 16 colored miniature basketballs, 4 miniature basketballs of any value ranging from either a 1, 5, 10, or 20 on the face of the ball. The higher the value, the more potential for gain or loss. A very conservative team could select several 5's, while a more aggressive team might select several 20's, while the more middle of the road team may select a mixture perhaps a 1, 5, 20 and a 10 ball. So the teams will choose 4 miniature basketballs based on what each is willing to risk. The remaining miniature basketballs remain in the possession of the chief contractor/operator. At the same time, the player/contestants must follow this same procedure with the assistant contractor/operator, choosing from their supply of 32 colored contract chips, 8 of any value ranging from either a 1, 5, 10, or 20 on the face of the contract chip to be used as wagers. Once all player/contestant shooters and bettors have established contracts with their contractors/operators then the player/contestants place their bets.

After the chief contractor/operator says all bets are closed, those placing wagers step away from the betting area and play begins The order of play is always red, black, blue and green to begin each quarter. Therefore, someone from the red team begins play and this would be the first session, the red session. This same player/contestant would also shoot the third quarter, while his partner would be the player/contestant shooter for the second and fourth quarters. When one member from all four teams have tossed their first ball all and all players/contestants have placed their wager for each toss, and the contractors/operators have paid all winning wagers and gotten paid for all loss wagers, and cleared all chips from the wager board, then the first quarter is complete.

Each player/contestant teammate alternates as the designated player/contestant shooter for his or her team per designated session. Each of the player/contestants must make a wager at each and every session of play. A session begins with the toss of a ball from a team represented by color, and ends with the payout of wagers and clearing the wager board of chips. The first session belongs to the red team, since they are designated to go first, while the second session would belong to the black team, the third session belongs to the blue team and the fourth session which completes a quarter belongs to the green team. The first session beginning the second quarter would belong to the red team, again, since they are designated to go first, the alternate team mate now gets to be the player/contestant shooter on all four of the teams. The second session of the second quarter would belong to the black team, the third session belongs to the blue team and the fourth session which would complete the second quarter, belongs to the green team. At this point, the game is at the halftime break, and new contracts must be established, the same as at the start of the game. At his discretion, the chief contractor/operator may offer his or her assistance to the assistant contractor/operator if play begins to lag at payout. Otherwise he or she can use this time to make electronic output or clever remarks with the handheld contract remote controller, thus keeping the crowd entertained. Not to be redundant but each time a different person shoots a ball marks the beginning of a session and that session ends once the wagers have been paid and the wheel and wager boards have been cleared by the contractors/operators. There are four sessions to a quarter, and four quarters to a complete game. For example, as shown below in Table One, as follows:

Session 1: Red 41 tosses Red team's 1st. ball. All player/contestants including Red #1 place a wager.

Session 2: Black 41 tosses Black team's 1st. ball.

All player/contestants including Black 41 place a wager. Session 3: Blue 41 tosses Blue team's 1st. ball.

All contestants including Blue 41 place a wager. Session 4: Green 41 tosses Green team's 1st. ball. All player/contestants including Green #1 place a wager. The first quarter is complete.

Second quarter begins

Session 1: Red 42 tosses red team's 2nd ball. All player/contestants including Red #2 place a wager.

Session 1 Black 42 tosses black team's 2nd ball, All player/contestants including Black #2 place a wager.

Session 3: Blue 42 tosses blue team's 2nd ball. All player/contestants including Blue #2 place a wager.

Session 4: Green 42 tosses green team's 2nd ball.

All player/contestants including Green 42 place a wager.

Once the second quarter is complete, it is halftime at which time all player/contestants still have two contracted miniature basketballs but will have no wager chips. Hence they must each return to the assistant contractor/operator to establish new contracts, following the same procedure as in the beginning of the game by selecting contract chips from their supply of colored contract wager chips, such as eight, of any value ranging from either a 1, 5, 10, or 20 on the face of the contract wager chip to be used as wagers. After selecting the wager chips the game continues, completing the last eight sessions in the same fashion as the first eight sessions. The third quarter begins with the legal member of the red team, red #1, acting as the designated player/contestant shooter.

Once the game participants contracts have been established and when everyone at the table has had a chance to place their wagers, the chief contractor/operator using his handy remote controller, spins the contract wheel while announcing no more wagers.' Once he or she says this, at that moment no one is allowed to place or change their wagers. Then as the contract wheel spins, the chief contractor/operator uses the contract remote controller to start the time clock to begin its second countdown, the designated player/contestant shooter now launches one of his team's two remaining contracted miniature basketballs towards the bull's-eye basket within the allotted 5 second time limit. The ball must land on the contract wheel and ultimately come to rest on one of the numbered slots of the contract wheel in order for the toss to be valid. A specially designed retaining wall (FIG. 7) is used for the puipose of keeping the ball in play. If the ball bounds out of the play area, outside the retaining wall, the player/contestant shooter is given a second chance. However, if after the second attempt, should the aforesaid player/contestant shooter's miniature basketball fail to land in play, the aforesaid player/contestant shooter is to be disqualified for that toss and the aforesaid player/contestant shooter must lose 200 points times the number on the face of the ball he or she tossed. The chief contractor/operator will now take the disqualified player/contestant shooter's ball, start the wheel again and drop the disqualified player/contestant shooters ball onto the spinning wheel and where it lands will be the basis for determining payouts or loses for all the wagers that are currently on the contract wager boards.

Only after the basketball drops on a slot and the two contractors/operators selects the winning numbers on the contract wager board, and clears all the losing wagers, after collecting debts for said losing wagers, then the process begins again with a new designated player/contestant shooter. Bettors can then start placing new wagers while the two contractors/operators pays the winners, collects debts from losers or makes change as necessary. The contract wheel has only 18 slots (FIG. 1) represented as follows: 10, 20, and 50 point slots, two of each on black and two of each on red, and two 100 point slots, one on black and one on red, For example the aforesaid numbers occupy spaces as such:

two 10 point slots on black at locations 22 and 15, two 20 point slots on black at locations 13 and 20, two 50 point slots on black at locations 18 and 29 one 100 point slot on black at location 27, two 10 point slots on red at locations 14 and 23, two 20 point slots on red at locations 21 and 30, two 50 point slots on red at locations 19 and 28, one 100 point slot on red at location 26, two lose 200 point slots which are yellow at locations 16 and 25, two bull's-eye slots worth 200 points which are green at locations 17 and 24 for a total of 18 slots (see FIG. 1).

The bull's-eye basket located at the center, (FIG. 2) is worth 200 points times the number on the face of the ball, should a player/contestant shooter player/contestant make a basket when he or she tosses the aforesaid ball at the contract wheel. Shooters toss the contracted miniature basketballs of values ranging from either a 1, 5, 10, or 20 (FIG. 3) at the bull's-eye basket, in an attempt to score the 200 points times the number on their contracted ball. For example a 10 ball accurately thrown into the bull's-eye basket would net the player/contestant shooter 2000 points in point chips, 4000 or double if he or she actually wagered to make on the wager board (FIG. 4). Should the same ball land on a black slot of any value that would net the player/contestant shooter additional points, actually 10 times the number the ball lands on.

However, should that same basketball after passing through the net, fall on the contract wheel only to end up on a red slot of any value, this would cost the player/contestant shooter valuable points, losing 10 times the number the ball lands on, or the number on the ball times the number of the slot unless of course he or she bets on that red number. The player/contestant shooter could also land on the loose 200 slot only to loose the 2000 point chips he or she just earned with the made shot. The ramification is that the contract game could be played using dollars as the wages in which case the contract wheel and the wager board would have all the same numbers and colors, only dollar signs would appear in front of the numbers and player/contestants would be compensated dollar amount chips instead of point chips; see FIG. 5*a*.

BRIEF DESCRIPTION OF THE DRAWINGS

The present invention can best be understood in connection with the accompanying drawings. It is noted that the invention is not limited to the precise embodiments shown in drawings, in which.

REFERENCE NUMERALS

Figure 1:
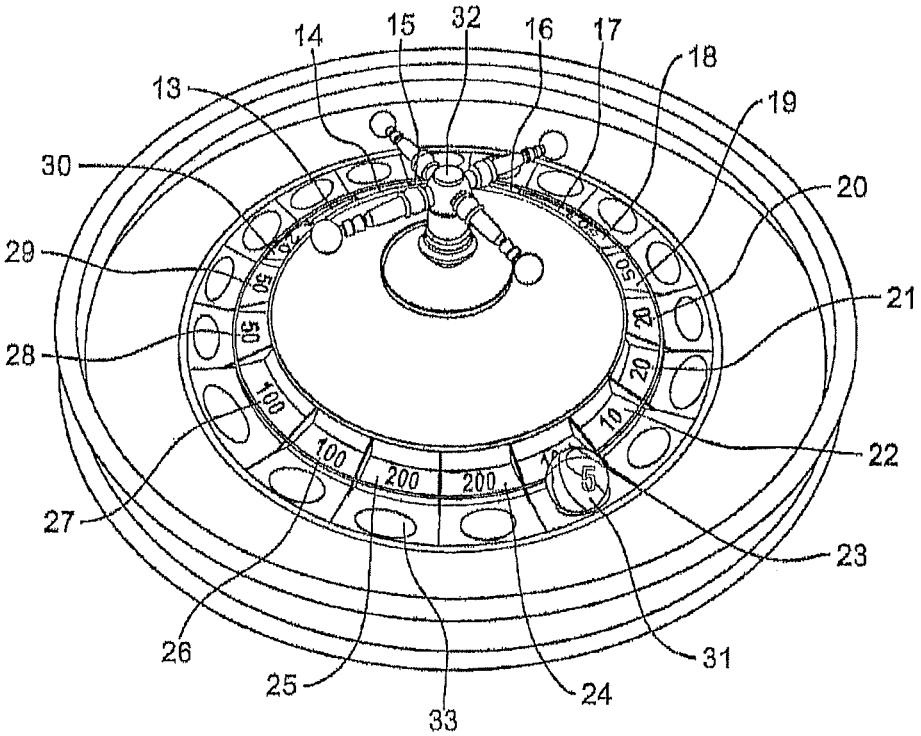
FIG. 1 is a perspective view of a contract wheel.

14 red 10 point slot
15 black 10 point slot
16 yellow lose 200 point slot
17 green bull's-eye 200 point slot
18 black 50 point slot
19 red 50 point slot
20 black 20 point slot
21 red 20 point slot
22 black 20 point slot
23 red 10 point slot
24 green bull's-eye 200 point slot
25 yellow lose 200 point slot
26 red 100 point slot
27 black 100 point slot
28 red 50 point slot
29 black 50 point slot
30 red 20 point slot
31 5× ball
32 contract wheel agitator
33 molded indenture, fits the contract ball once it lands on the contract wheel
34 net
35 backboard
36 screw
37 Contract logo
38 basket
39 1× ball
40 5 second clock
41 10× ball
42 20× ball
43 red speckled Contract 10 point chip
44 black speckled Contract 20 point chip
45 green speckled Contract 50 point chip
46 blue speckled Contract 100 point chip
47 gold speckled Contract 1000 point chip
48 strobe lights
49 1× point chip
50 5× point chip
51 I O× point chip
52 20× point chip
53 retaining wall
54 encourage button, one of four programmable buttons
55 line in calculator window
56 programmable buttons 1-4
57 active phrase above the line
58 calculator on-off button

DETAILED DESCRIPTION OF DRAWINGS

FIG. 1 shows a Contract Wheel. This is no ordinary Roulette wheel, this contract wheel preferably has only 18 slots represented as follows: 10, 20, 50 and 100 point slots, two of each on black and two of each on red. For example the aforesaid numbers occupy spaces as such: two (2) 10 point slots on black at locations 13 and 22, two (2) 20 point slots on black, at locations 13 and 20 two (2) 50 point slots on black at locations 18 and 29 one (1) 100 point slot on black at location 27, two (2) 10 point slots on red at locations 14 and 23, two (2) 20 point slots on red at locations 21 and 30, two (2) 50 point slots on red at locations 19 and 28, one (1) 100 point slot on red at location 26, two lose 200 point slots which are yellow at locations 16 and 25, and two (2) slots for the bull's-eye worth 200 points which are green, at locations 17 and 24 for a total of 18 slots, Each slot is fitted with a molded indenture at location 33, designed to fit the contract ball, at location 31, once it lands on the contract wheel. The four-armed agitator at location 32 is designed to make the landing of the shot more unpredictable as it hits the player/contestant's ball prior to its landing on the wheel.

Figure 2:
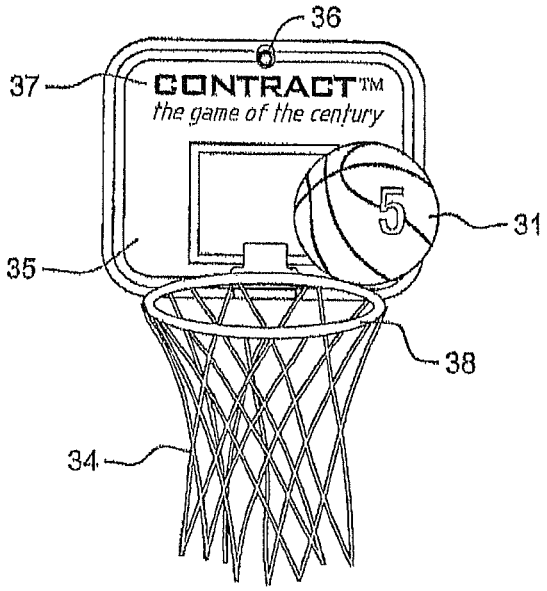
FIG. 2 is a front perspective view of the bull's eye basket, shown with a miniature basketball.

FIG. 2 shows the bull's eye basket for a miniature basketball, including a basket at location 38 with a net located at location 34, positioned at rear and center of the contract wheel attached to a backboard at location 35 containing the contract logo at location 37. This bull's eye basket will be attached to the back of the retaining wall to a wall mount that juts the basket into the center of the wheel of play and is secured there by a screw at location 36. Shooters can score 200 points times the number on the face of the ball at location 31 should they make the basket on the way to the contract wheel. Shooter can double their score by making a wager and landing on the wagered slot no matter what they wager. Shooters cannot lose points for missing the basket, unless they wagered on the wager board to make but then missed the shot. However the aforesaid player/contestant shooter can also lose points if his ball lands on a red slot of any value or lands on the lose 200 slot, again, unless a wager was made to land on that exact red number or lose 200 yellow slot in which case the player/contestants wins the number on his wager chip times the number on the wagered red space or the wager chip number times 200 in the case of the yellow slot.

Figure 3:
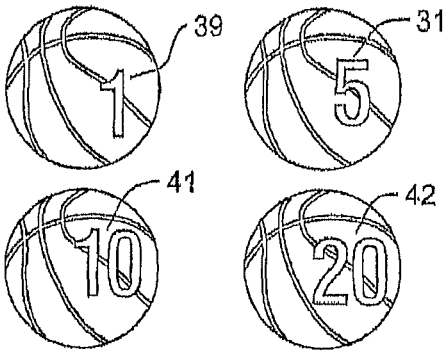
FIG. 3 is a perspective view of a set of miniature contract basketballs.

FIG. 3 shows contract balls. These miniature basketballs, like the contract wager chips have either a 1 as at location 39, 5 as at location 40, 10 as at location 41, or 20 as at location 42 on the face and are used to make wagers on the play. They are colored: red, black, blue and green and each color represents a team. Teammates play only their own colored miniature basketballs and use only their own colored wager chips to make bets. The hall, resembling a basketball, is roughly the size of a ping-pong ball but is made of firm rubber. The chief contractor/operators and the designated player/contestant shooter handle the ball per session. These miniature basketballs remain with the chief contractor/operator at all times and he or she removes them from the contract wheel at the end of each session of play.

Figure 4:
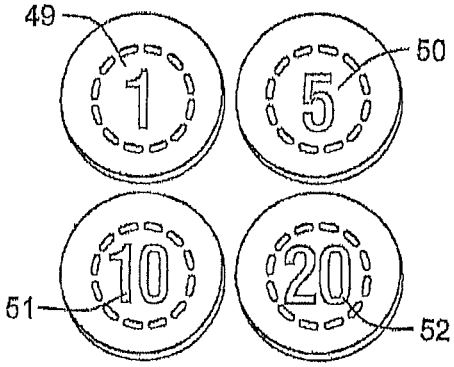
FIG. 4 is a perspective view of a set of contract wager chips.

FIG. 4 shows a set of contract wager chips. These chips are solid in color, and like the miniature basketballs have either a 1, 5, 10, or 20 on the face and are used to make wagers on the play. Unlike the point chips, however the contract chips have no point value and are not used to make payout but rather are used solely to make contract wagers. They are colored: red, black, blue and green and are linked with the teams of the same colors thus allowing the contractor/operator to distinguish what team made the wager and thus speeding play along. The assistant contractor/operator, the bettors and the player/contestant shooter all handle the contract chips during each session, however, charge of these chips remain with the assistant contractor/operator at all times and he or she alone removes them from the contract wager board at the end of each session of play.

Figure 5:
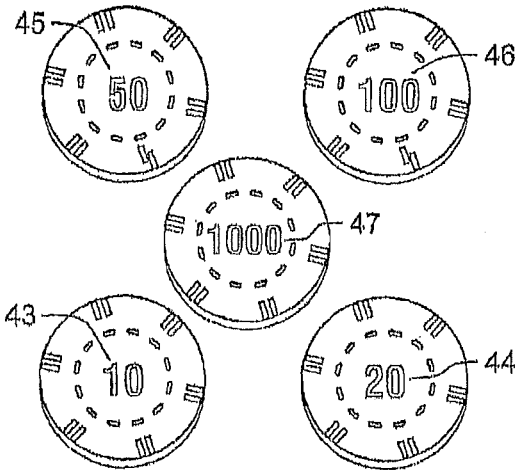
FIG. 5 is a perspective view of a set of contract point chips.
Figure 5A:
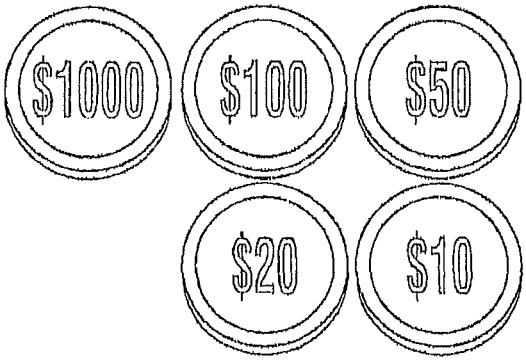
FIG. 5*a* is a perspective view of a set of contract money chips.

FIG. 5 shows a set of contract point chips: These differ in purpose as well as in appearance from the contract wager chips, Whereas the wager chips are solid in color, and represent a team, the point chips have white markings that give them a speckled look when stacked and are in no way associated with any particular team. Also, these point chips are used to pay out wagers and are not to be used to make wagers. The point values are as follows: red chips are worth 10 points each, black chips are worth 20 points each, blue chips are worth 100 points each, green chips are worth 50 points each, gold chips are worth 1000 points each. Each player/contestants on all four teams starts the game with the same amount of chips; 3000 points distributed in these values; 1 gold point chip (1000), 10 blue point chips, (1000), 1.0 green point chips (500), 20 black point chips (400) 10 red point chips (100). These 3000 points will, be provided to all player/contestants in their very own team colored chip sack, Game can be played using cash values in place of points in which case all rules remain the same only chips look differently and have dollar signs on them. (see FIGS. 8 and 5*a*)

Figure 6:
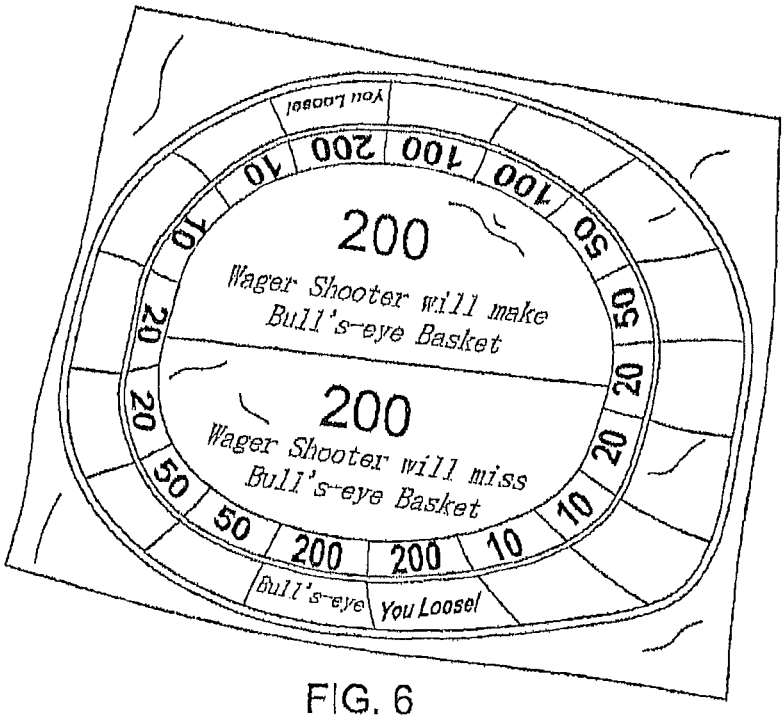
FIG. 6 is a top plan view of the contract wager board.
Figure 6A:
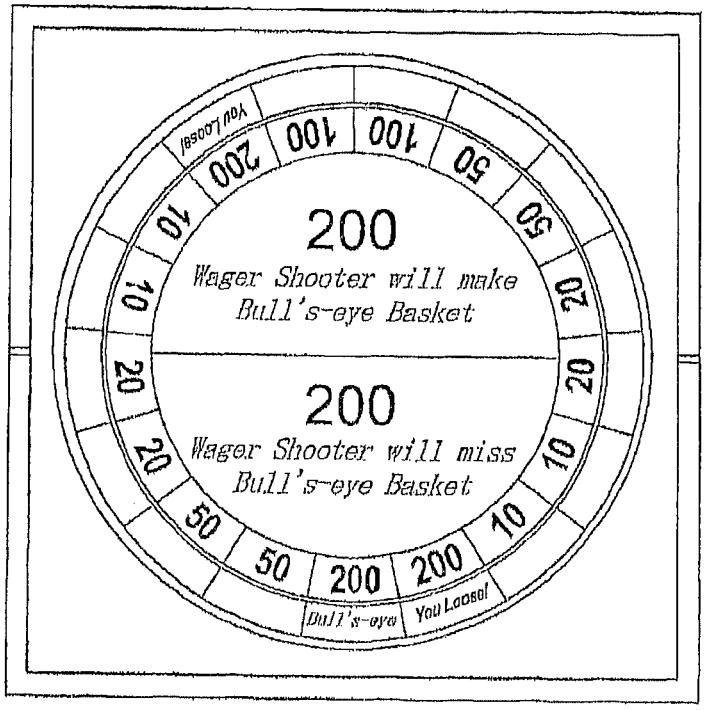
FIG. 6*a* is a top plan view of another contract wager board.

FIGS. 6 and 6*a* show the contract wager board. Every choice on the contract wheel has a corresponding selection represented on the wager board. For example the numbers occupy spaces as such: two 10 point spaces on black, two 20 point spaces on black, two 50 point spaces on black one 100 point space on black, two 10 point spaces on red, two 20 point spaces on red, two 50 point spaces on red, one 100 point space on red, one lose 200 point space which is yellow, one space for wagering that the player/contestant shooter's tossed ball will land on the bull's-eye slot worth 200 points, which is green and is identified by appearance as it looks like a slot on the wager board, one space to wager a player/contestant shooter will miss his toss at the bull's-eye worth 200 points which is green, located in the right center half of the wager board and one space to wager the player/contestant shooter will make his toss at the bull's-eye worth 200 points which is green, located in the left center half of the wager board for a total of 19 spaces. The aforesaid designated player/contestant shooter and all the bettors place wagers on any of the selections and by so doing either earn or loose point chips. The wager board could be a vinyl material, wood or metallic, etc.

Figure 7:
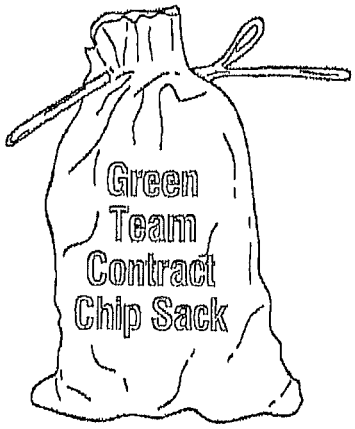
FIG. 7 is a perspective view of a contract chip sack.

FIG. 7 shows the contract chip sack. Both teammates an all four teams get one of these drawstring bags at the start of the game. Each one's sack will contain 3000 points in chips to begin the game. Player/contestants will keep their chips in these sacks at all times unless they are making change, or paying one of the contractors/operators for a lost bid. At the end of the game the teammates of the red and black teams will give their sacks containing all their chip earnings to the chief contractor/operator to tally, while the teammates from the blue and green teams will give their sacks containing their said chip earnings to the assistant contractor/operator to tally. Once all teams scores have been tallied a winning team is announced.

Figure 8:
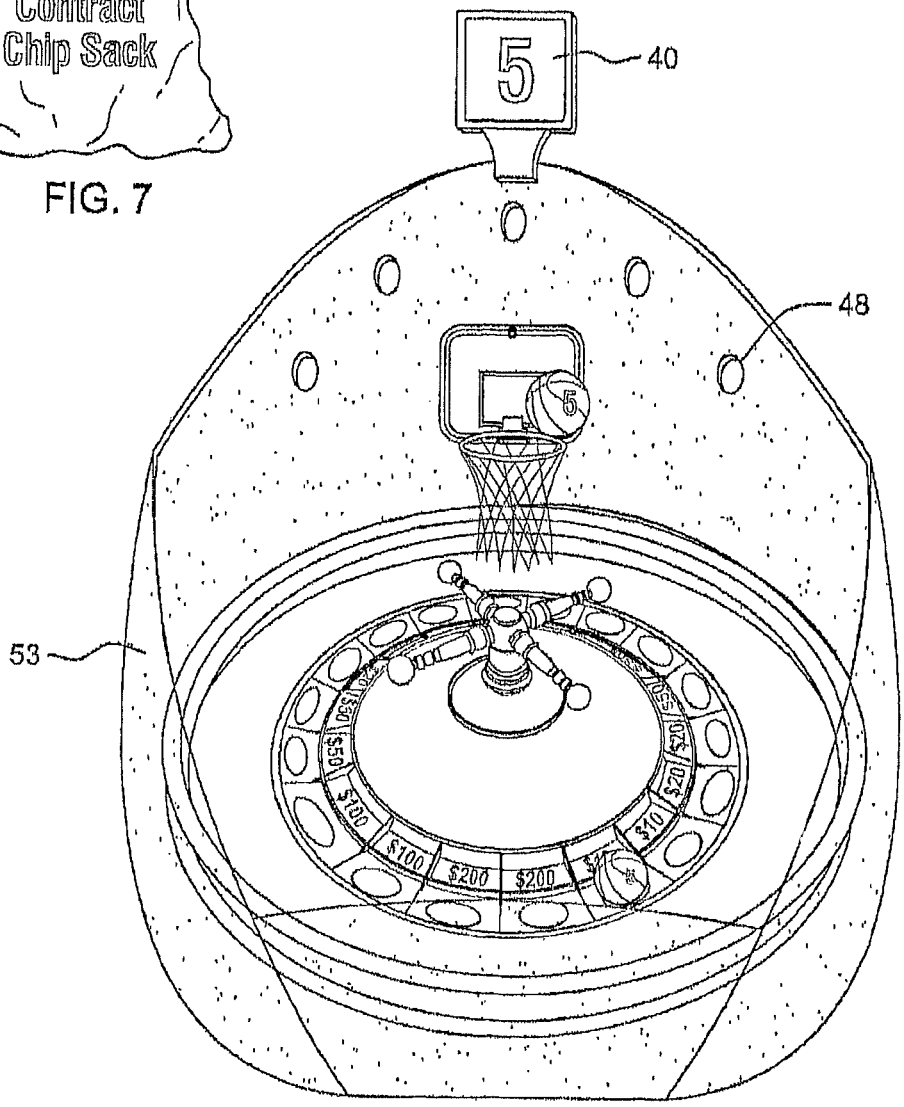
FIG. 8 is a perspective view of the contract game assembly, with a bull's eye basket for a miniature basketball, Roulette wheel, strobe lights, retaining wall and time clock.
Figure 9:
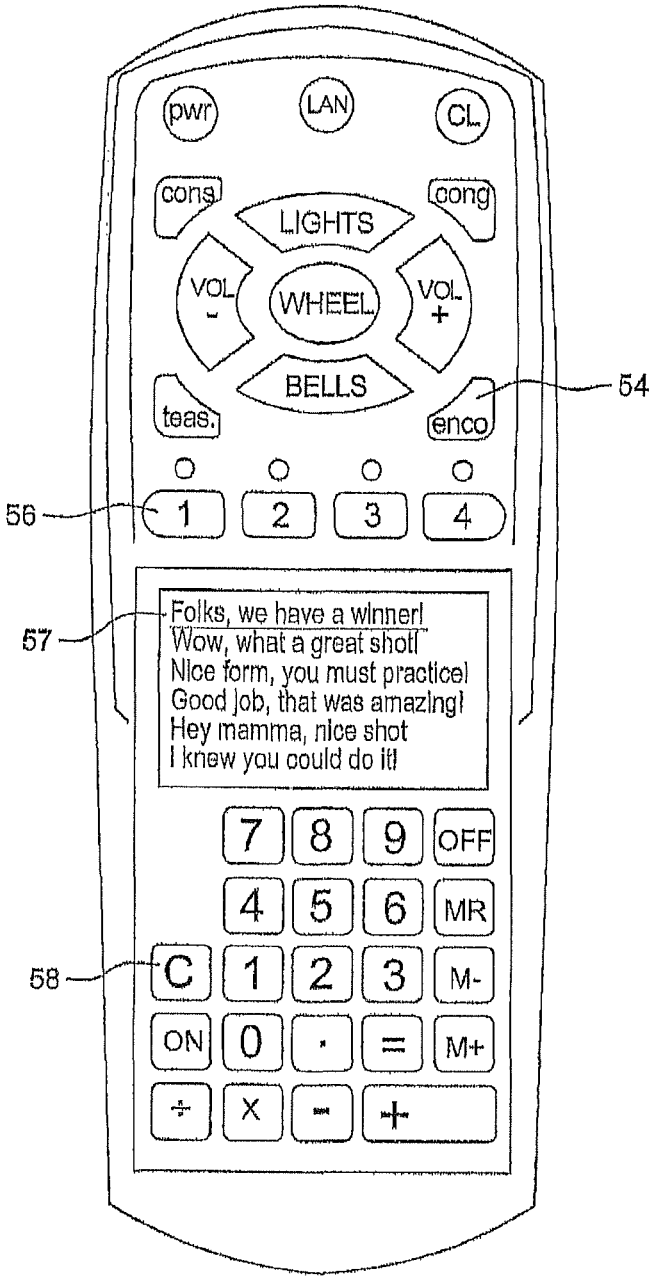
FIG. 9 is a front view of a hand operable contract remote controller.

FIG. 8 shows the contract the game of the century features specially designed retaining wall used for the purpose of keeping the ball in play. The aforesaid wall is made of a see-through material like plastic so that the ball is visible to player/contestants and onlookers at all times. The retaining wall has flashing strobe lights. These lights are built into the retaining wall, there are five of them and they flash in a strobe-like effect each time a player/contestant shooter makes a basket. These lights are triggered by the handheld electronic contract remote controller which is in the possession of the chief contractor/operator, he or she triggers the lights which are accompanied by bells, and he or she starts the time clock, also built into the retaining wall and is also activated by the contract remote controller at the command of the chief contractor/operator at the beginning of each toss. The source of the power is plug in electric, however the game is also battery operated and have (4) 9 volt batteries housed in the base of the contract wheel. Such source powers include:

(1) flashing strobe lights
(2) ringing bells
(3) personality voices
(4) time clock
(5) spinning contract wheel FIG. 9 shows the contract remote controller, used solely by the chief contractor/operator. The aforesaid chief contractor/operator uses the aforesaid remote controller to start the time clock, start the wheel, activate the flashing lights, when a attempt is negative he or she uses one of his programmed buttons to make an expression of disappointment in the case of a failed attempt or jubilation when an attempt is successful.

The remote controller also serves as a calculator to assist in calculation of payouts and for tallying point chips at the end of the game to determine a winning team. The remote controller also features much more as described later in the section entitled "how to operate the remote controller".

Operation

The chief contractor/operator, uses the handheld battery operated contract remote controller to spin the contract wheel, activate the strobe lights, bells and personalities to make the game exciting.

The aforesaid handheld remote controller is also used by the chief contractor/operator to aid in multiplying, adding and subtracting to keep the scoring accurate.

The remote controller is also used for accurately calculating debts or earning made from wagers made on the wager board.

The window of the calculator is used for programming when the following abbreviations "cons", "cong", "teas", and "enco" buttons are individually pressed simultaneously with any of the programmable keys 1-4. Once the keys have been programmed and the red light goes out the window now displays the selection of phrases the player/contestant has to choose from. The pressing of the number "one" one (1) button, a listing of phrases appears in the window with one phrase appearing above the line in the calculator window, while all other are below the aforesaid line. If the player likes like the phase and wants to hear it in the language and personality the player pre-programmed, press the button again and that phrase and only that one above that line will play. When double pressing the 1 button in quick succession, it plays the last message you played, and activates the lights, bells and applause all together. If pressed and the 1 button is held, it repeats that same last message over and over while activating the lights, bells and applause until you release it. If the player wants to go to another phrase, the user uses the scroll button to move the text up or down. If the user chooses not to program it has a default setting. Turning off the remote controller and turning it back on and it defaults to English language, and the remote controller then defaults to the last personalities entered into the remote controller. The user does not even have to scroll through the choices of expressions to choose one but the player may choose instead to play the buttons blindly and be surprised along with everyone else at what the remote controller comes out with. At any time during the game should a player need the calculator, the contractor/operator of the remote controller simply presses the red on/off button located below the calculator window and the calculator functions will be available to the viewer. When done with the contractor/operator's calculations, pressing the red on/off button again turns off the calculator functions and the window goes right back to where it was prior to turning on the calculator. The handheld remote controller is battery operated and has the following function buttons shown in FIG. 9:

PWR—power button is the red button located in the upper left corner. Use it to turn on the remote controller. This button turns on the calculator for programming buttons only, the calculator has its own red on/off button in the lower left corner and it should be used when the contractor/operator wants to do calculations solely.

LAN—language button, located in the uppermost middle of the remote controller, allows the contractor/operator to program a personality from a choice of four different languages; English, Spanish, German or Italian. English is the default language, however any number of languages can be programmed beyond even these at the discretion of the manufacturer.

CL clock button is one of four blue buttons surrounding the wheel button, this button located just above the wheel button, starts the 5 second clock's count down. Buttons 1 through 4 are programmable, each has a variety of different expressions designed to induce applause and laughter from an on looking crowd. If the contractor/operator presses and holds the any of these buttons, 1-4, after these have been programmed, those buttons 1-4 will repeat the last expression played over and over and activates the electronic images of lights, bells and applause until the user releases it. "Cons" button—"Console" button located just below the pwr (power) offers expressions of consolation for a missed shot or a loss wager and is used to console game participants after something negative happens. It can be programmed in this way; pressing the cons button simultaneously with the LAN button, and a choice of English, Spanish German or Italian will appear in the calculator window. The contractor/operator makes sure the choice of the language is above the line and press the LAN button alone. After selecting a language, next contractor/operator presses the cons button simultaneously with the 1 button, a red light above the 1 turns on, and the players see a selection of personalities such as maniacal, gnome, syfy, temptress, egor, valley girl, etc., appearing in the calculator window. The contract/operator scrolls through these and makes sure the personality selected is above the line in the calculator window, then presses and holds one button until it beeps and the red light goes off The contractor/operator has now programmed the 1 button to console in a language and personality of the player's choice. Defaulted into the remote controller are expressions like; "Alibi', you were robbed!" or "Too bad, better luck next time!" or "Oops, you loose!" or "If it weren't for bad luck, you'd have no luck at all!" etc.

"Cong" button—Congratulate button located just below the CL or clock button is a collection of expression of congratulations for a made shot or a winning wager and is used to cheer on game participants after something positive happens. It can be programmed in this way; press the cong button simultaneously with the LAN button and a choice of English, Spanish German or Italian will appear in the calculator window selecting one and making sure a choice is above the line in the calculator window, then the contractor/operator presses the LAN button alone. Now the contractor/operator presses the cong button simultaneously with the 2 button, a red light comes on above the 2 button and the players see a selection of said personalities maniacal, gnome, syfy, temptress egor, valley girl, etc. appearing in the calculator window. The contractor/operator makes sure the aforesaid personality selected is above the aforesaid line in the calculator window then press and hold 2 button until it beeps and the red light goes off. The contractor/operator has programmed the 2 button to congratulate in a language and personality of the player's choice. Stored into the remote controller to be programmed are expressions like; "Folks, we have a winner!" or "Wow, what a great shot!" "That sir, was impressive!", etc.

"Teas" button: The tease button located just below and left of the bells button is verbiage meant to poke fun at the player/contestant and generate laughs from the on lookers. Bystanders will be motivated to join in the first chance they get to be a part of the fin. The "teas" button can be programmed in this way; pressing the "teas" button simultaneously with the LAN button and a choice of English, Spanish German or Italian appears in the calculator window. Selecting one, the player makes sure the choice is above the line in the calculator window, and presses the LAN button alone: Now, the user presses the teas button simultaneously with the 3 button and a red light above the 3 button will turn on, at the same time the player/contestants will see a selection of personalities such as maniacal, gnome, syfy. temptress, egor, valley girl, etc., appearing in the calculator window. The contractor/operator of the remote controller makes sure the player's choice is above the line in the calculator window and presses and holds 3 button until the player hears the beep and the light goes off. The contractor/operator has now programmed the 3 button to tease in a language and personality of the player's choice. Stored into the remote controller to be programmed are expressions like; "You throw like my sister!", "What kind of shot was that?", or "Perhaps if we moved a little closer!" or "Are you kidding me???" or" I'd say, "The form needs a little work!!" or "Such skill!, such athleticism, such—okay, maybe a little luck!" or "You should fire your mom as your basketball shooting coach," etc.

Enco—Encourage button located just below and right of the bells button are expressions meant to spur on the player/contestant just prior to his shot or while the ball is on the spinning wheel or while anticipation is building as the ball spins round the contract wheel prior to settling on a slot. The enco button can be programmed in this way; press the enco button simultaneously with the LAN button and a choice of a choice of said languages will appear in. the calculator window. Select one, making sure the choice is above the line in the calculator window, and press the LAN button alone. Now the contractor/operator presses the enco button simultaneously with the 4 button and a red light will turn on above the 4 button, so that the player/contestant will see a selection of said personalities appearing in the calculator window. The contractor/operator makes sure the choice is above the line in the calculator window and presses and holds the 4 button until it beeps and the red light goes off. The contractor/operator has now programmed the 4 button to encourage in a language and personality of the choice. Stored into the remote controller to be programmed are expressions like; "Relax, you can do IV", "I feel a victory dance coming on!" or "Yes! Yes! Yes! Let's get ready to celebrate!" "I've never witnessed such skill!" or:" You madam, are quite skilled!"

BELLS/LIGHTS—Lights button is one of four blue buttons surrounding the wheel button, this button located just above the wheel button activates the flashing strobe lights and the ringing bells simultaneously. Pressing it once and only the lights are activated but if the contractor/operator double presses the button in quick succession, both the lights and the bells are activated. The same is so concerning the bells button located just below the wheel button; pressing it once and only the bells are activated, but if the contractor/operator double presses the button in quick secession, both the lights and the bells are activated, so no programming is needed.

VOL+ and Vol− These two buttons situated opposite one another are used by the contractor/operator to control the volume and affects all sound related buttons by default when the contractor/operator lowers or raises the volume, however to effect individual aspects for example, the contractor/operator first presses the 1 button and lets a personality speak and while the voice is speaking, lower or raise the volume to his or her liking. Because only the 1 button was activated the volume change will affect only that button. The Vol+ button is also used for scrolling up when used along with the program buttons 1-4 or for maneuvering text too long to read in the window to the left for readability. In the case when a line does not fit in the window because it is too long, use the volume + to move the text to the left to continue reading. The contractor/operator uses it to move the text to the right. Should the contractor/operator go to the end and keeps going, the contractor/operator will simply make all lines move up one row or down one row depending on if the contractor/operator scrolls right −, or left +.

However, once the buttons have all been programmed and the light goes out under them, the Vol+ button defaults back to a volume increase button and the Vol− button used to scroll down returns to its primary function of lowering the volume.

Bells—This button turns on the bell sounds. Pressing it once and only the bells sound but if the contractor/operator double presses the button both the bells and the lights are activated simultaneously, Wheel—This button activated the Contract wheel. Press it once while the wheel is motionless and it starts the wheel turning. If left alone the wheel on its own would gradually come to a stop. However, the Chief Contractor/Operator can begin to stop the wheel once the ball falls onto the contract wheel by simply double clicking the wheel button and this automatically causes the wheel to slow to a stop.

Other changes can be made to the present invention, within the scope of the claims.

I claim:

1. A game assembly for a game associated with instructions and rules for use in playing the game, said assembly comprising:

a housing having a spinning wheel with slots and numbers used for making wagers;

a wager calculations device, said housing further having a miniature basketball net through which a player participant throws a miniature basketball onto said spinning wheel, and a plurality of miniature basketballs having varying point denominations thereon for wagering; and, a hand-held remote controller controlling time limits per unit of said game; and, said hand-held remote controller controlling audio visual displays displayed on said housing and being related to said game.

2. The game assembly as in claim 1 wherein said wager calculations device is said hand-held remote controller.

3. The assembly of claim 2, further comprising a buzzer and a time clock, wherein a said hand-held remote controller is programmed to be used in several languages and with selected phrases:, and wherein:

said hand-held remote controller may be used as a calculator to start said spinning wheel to spin, and to start said time clock, which allows time to toss a said miniature basketball at said basket before said buzzer sounds.

4. The game assembly as in claim 1 wherein said wager calculations device is a flat wager board having numbers that occupy spaces displayed thereon.

5. The assembly of claim 1 further comprising strobe lights and bells, each of which are activated by said hand-held remote controller.

6. The assembly of claim 1 further comprising team identifiers.

7. The assembly of claim 1 further comprising a plurality of chip sacks, comprising chips, which are related to points.

8. The assembly of claim 1, further comprising a ball for use with said spinning wheel, wherein said spinning wheel has a grooved gutter having slots with indicia, some of which are associated with different colors, said slots used for said ball to land in one thereof.

* * * * *